United States Patent [19]

Young, Jr. et al.

[11] Patent Number: 4,742,968

[45] Date of Patent: May 10, 1988

[54] BEAM WINDER AND METHOD OF USING SAME

[75] Inventors: William O. Young, Jr., Spartanburg; Mansel A. Jennings, Inman; George H. Lark; Julian E. Hankinson, Jr., both of Spartanburg, all of S.C.

[73] Assignee: Young Engineering, Inc., Spartanburg, S.C.

[21] Appl. No.: 860,642

[22] Filed: May 7, 1986

[51] Int. Cl.[4] ..... B65H 17/02; B65H 17/08; B65H 23/00

[52] U.S. Cl. ..... 242/65; 242/72 R; 242/72.1; 242/75.2

[58] Field of Search ..... 242/65, 68.4, 75.2, 242/72 R, 72.1

[56] References Cited

U.S. PATENT DOCUMENTS

| | | | |
|---|---|---|---|
| 2,922,592 | 1/1960 | Kaltenbach | 242/72 X |
| 3,670,980 | 6/1972 | Mukai et al. | 242/75.2 X |
| 3,687,388 | 8/1972 | Pfeiffer | 242/65 |
| 3,946,960 | 3/1976 | Hunter | 242/65 |
| 4,111,377 | 9/1978 | Tetro et al. | 242/65 X |
| 4,150,797 | 4/1979 | Kataoka | 242/75.2 X |
| 4,552,317 | 11/1985 | Halter | 242/75.2 X |

*Primary Examiner*—Stuart S. Levy
*Assistant Examiner*—Thomas R. Hannon
*Attorney, Agent, or Firm*—Dority & Manning

[57] ABSTRACT

A winder for textile fabrics or other web materials including a frame having spaced apart support arms pivotally secured thereto. Each support arm has a core holding chuck at the outer end of same, at least one of which is torque driven. A surface drive roll is located on the frame to receive material and apply same to the roll of material being produced. A load cell associated with the surface drive roll measures nip pressure at the interface between the surface drive roll and the roll being formed and is associated with a pneumatic bellows or the like via a control system to cause movement of the support arm for maintenance of a predetermined nip pressure at the drive roll interface. The chucks for holding winding cores include a plurality of arms pivotally secured within a chuck housing which are pivotally movable to an extended core engaging position.

33 Claims, 4 Drawing Sheets

BEAM WINDER AND METHOD OF USING SAME

BACKGROUND OF THE INVENTION

The present invention relates to a winder for particular use in the textile industry for the winding of continuous length web material onto a beam under controlled density conditions.

In the processing of continuous webs, principally textile materials, the handling of the materials during passage through the various conventional processes is particularly important in order to ensure high quality materials. In particular the handling of a textile web during certain processes can lead to adverse effects in further downstream processes resulting in unacceptable or second quality goods, or a necessity for reprocessing. A prime example of such a process is the winding of a textile fabric onto a beam for subsequent dyeing of same on the beam.

While textile materials may be dyed according to a number of different processes, one such process as mentioned above, involves production of a roll of fabric about a metal beam or core which is perforated, and subsequent placement of the entire beam or roll of fabric into an appropriate dye vessel where the dyeing of the fabric is accomplished on the beam. Normally, beams of textile material are significant in size, having a length in excess of one hundred inches and weighing several thousand pounds. With the beam or core perforated, dye liquor may be introduced internally of the beam and pass under pressure therethrough, flowing outwardly through the various fabric layers that are located around the beam. In the event a beam of fabric is improperly wound, i.e. the density of fabric around the beam is not correct for the particular style of fabric, improper dyeing can result. Specifically, if the fabric is wound too tightly around the beam it becomes increasingly difficult for the dye liquor to properly penetrate the individual fabric layers to achieve even dyeing. Conversely, a fabric wound too loosely around a beam will permit the dye liquor to pass too rapidly through the various layers of fabric, or to escape the roll, both perhaps leading to improper dyeing. Still further, should the roll of fabric include certain layers that are tightly wound and certain layers that are loosely wound, again dye liquor will not make proper contact with the individual layers of fabric, to yield even dyeing.

In the event an uneven dyeing results, it generally then becomes necessary, if possible, to unwind the fabric from the beam, reprocess the fabric to produce a further beam and redye same. All of such reprocessing leads not only to excessive costs and production time, but likewise a second dyeing operation may be limited to certain colors or shades by the prior dyeing operation.

In a conventional processing sequence, fabric is passed through a number of pieces of process equipment prior to being wound onto a dye beam. Without specificity, since such does not form a part of the present invention, suffice it to say that it is important that fabric be wound onto a beam in a proper disposition such that appropriate dyeing may be subsequently achieved. It has been conventional for knit fabrics that, immediately prior to being wound onto the dye beam, fabric is passed through a tenter frame where it may be dryed, heat treated or the like, but where primarily, for purposes of proper winding onto a dye beam, the fabric is engaged at opposite selvages by clips or pins and moves through the tenter frame in a controlled open width condition. Tenters, in fact, often have the capability to control a fabric to present the fabric in an appropriate and flattened condition at the exit from the tenter where the fabric begins its movement around a dye beam or core.

Winders in general that have heretofore been utilized in the textile industry, have taken a number of forms. Systems have been employed where the core or beam only is driven for the winding of fabric therearound, conventionally referred to center drive winders. Additionally, winders have heretofore been produced where a driven roll is maintained adjacent an outer surface of the beam in contact with the beam initially and thereafter the outer layer of fabric, affording rotation to the beam for the formation of continuous fabric layers therearound. Such winders have conventionally been referred to as surface drive winders. Still further, winders have heretofore been provided with both center drive and surface drive capabilities, again attempting to produce a properly wound roll of fabric.

Still further, prior art winders have included pivotal support arms which are movable away from a surface drive unit as the diameter of the roll being produced increases. On such prior art winders, relative speed control of the surface drive unit has been utilized, for example, to afford a slight overfeed or underfeed of fabric to the roll being formed in an attempt to achieve a generally loosely or tightly wound roll of fabric, whichever is desired.

In all of the prior art winders alluded to above, it has been difficult to operate same while achieving a controlled density roll of fabric. As stated above, it is important to control density of the roll of fabric such that appropriate dyeing of same may be achieved. Along these lines, for example, it may be that a constant density across the diameter of the roll is desirable, or that a variable density profile be maintained across the diameter of the roll. Such factors could depend on fabric style, the dyeing process, or the like.

It has also historically been the case that handling of large beams or cores has involved manipulation of the beam with overhead cranes, or the like into a proper position relative to support arms. Once the beam is located in approximately the right position, conical chucks, normally of metal, are driven into open ends of the cores from adjacent support arms for proper location of the core for a subsequent winding operation. Not only is such arrangement time consuming and labor intensive, but also forces applied by the chucks against the cores in a metal-to-metal contact often creates damage to the core or beam, such as by enlargement of the inside diameter of same.

Certain winding of fabrics has heretofore been attempted for production of a controlled, constant density roll of fabric by way of surface drive only or by way of a surface center drive arrangement. One such further approach has involved surface-center drive winders where the surface drive unit is maintained out-of-contact with the roll being formed. The surface roll in such an arrangement thus acts only as a feed roll. Such an arrangement is fraught with problems stemming from uneven density. For example, it is apparent that a larger roll is heavier than one being newly formed. As a roll becomes heavier, obviously corrective measures are needed since nip pressure at the surface drive roll increases. Removal of the surface drive roll from contact with the roll to reduce nip pressure has resulted in density variation as well as other problems.

The improved winder of the present invention overcomes the problems noted above with prior art winders and is capable of producing a roll of fabric or other web material whose density may be controlled throughout the diameter of the roll. At the same time improved overall handling of cores and webs are both achievable.

While the known prior art has been generally set forth above, it is not believed that such is adequate to anticipate or suggest the method and structure according to the present invention as is described and claimed herein.

SUMMARY OF THE INVENTION

It is an object of the present invention to provide an improved beam winder.

Another object of the present invention is to provide an improved beam winder that is a combination surface-center drive winder, and is capable of producing a wound fabric roll of controlled density.

Still further another object of the present invention is to provide an improved beam winder having chuck means thereon for supporting a core that results in improved handling of the core during both loading of the core onto the winder and the subsequent winding operation.

Still another object of the present invention is to provide an improved method for winding fabric onto a core to achieve a controlled fabric density around the core.

Yet another object of the present invention is to provide an improved method for producing a roll of a continuous length of material while controlling the density of the material on the roll.

Generally speaking, the winder of the present invention comprises a support frame; a pair of spaced apart arms pivotally secured to said frame, said arms having chuck means at outer free ends of same for receiving and supporting a winding core therebetween; means for moving said arms about said pivotal connections to properly locate said arms for receiving a web around a core held therebetween; a surface drive roll located across the space between said arms and supported for rotation thereat; drive means for at least one of said chuck means and said surface drive roll; sensor means associated with said surface drive roll for determining nip pressure generated at the interface between said web being wound and said surface drive roll; and control means operatively associated with said arm moving means and said sensor means for locating said arms relative to said drive roll while maintaining predetermined nip pressure at said drive roll interface.

More specifically, the improved winder according to the present invention includes a pair of spaced apart, pivotally movable arms that are preferably independently controllable. Density of a roll of web material being produced can thus be more closely controlled. Each such independent arm in the preferred arrangement is provided with a means for moving same about its pivotal connection at the frame responsive to surface drive roll nip pressure. Pneumatic means are utilized in a preferred embodiment for properly positioning the support arms with respect to the surface drive roll, and most preferably include an air bellows located between a portion of the frame and an underside of the support arm. Inflation of the bellows moves the arm away from the surface drive roll and reduces nip pressure while deflation of the bellows permits the support arm to move downwardly and increases nip pressure.

In achieving a controlled density roll of web which preferably, as noted above, is a textile fabric, the speed of the surface drive roll which initially applies web onto the roll is controlled relative to linear speed of web being fed thereto. Furthermore, a predetermined nip pressure or nip pressure range is maintained at the interface between the surface drive roll and the outer layer of the roll of web material being formed. With a controlled nip pressure a roll of web may be produced having a predetermined controlled density from inside layers to outside layers of web. Since the roll during formation becomes larger and larger, a varying distance between the core on which the web is wound and the surface drive roll is unavoidable. Such varying distance coupled with web wound around the core is in part determinative of nip pressures produced at the surface drive roll interface.

Hence in a preferred embodiment of the present invention, a control system is utilized to move the support arms away from the surface drive roll during roll formation in a manner that a preselected nip pressure or pressure range is maintained at the surface drive roll interface. Particularly, the control circuit, using nip pressure as a target value causes air to be pulsed into the preferred air bellows arrangement for each arm if dictated to cause expansion of the bellows and movement of the support arms away from the surface drive roll. A lessening of measured nip pressure results. Conversely, deflation of the bellows creates an increase in nip pressure.

Sensor means are utilized for determining nip pressure at the surface drive roll web roll interface and preferably are pressure transducers or load cells. The sensor means is located beneath a bearing support plate on which a bearing is located that rotatably supports an end of the surface drive roll with the nip pressure force supplied to the load cell therethrough. In order that more accurate pressures can be detected, the surface drive roll is arranged with respect to its driving means such that forces created by the driving means and/or other extraneous forces are eliminated by proper placement of the drive means. Notably, an elongated pivot arm is preferably arranged between the bearing support plate and the load cell with the drive chain or other endless drive means for the roll passing through a plane that extends through a central axis of the pivot location of the pivot arm.

Winders of the present invention are preferably provided with chuck means at outer free ends of the support arms which will receive and support a core or beam more accurately and much less destructively than prior art chucks. Such chuck means for said support arms include a cylindrical housing having a plurality of holding means retracted therewithin in an inoperative state, and with beam support elements secured thereto and protruding therefrom for initial receipt of a winding core. Once a core is in place on the support or cradle elements, overhead cranes, hoists or the like may be disassociated therefrom. Thereafter, chuck actuation means cause a plurality of core holding elements to move out of retracted positions within the chuck housing and into holding engagement with an inside surface of a core located thereat. Subsequent to production of an appropriately sized roll of fabric, a retraction of the core holding means permits the roll to be removed from the winder.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF PREFERRED EMBODIMENTS

Making reference to the FIGURES, preferred embodiments of the present invention will now be described in detail.

Figure 1:
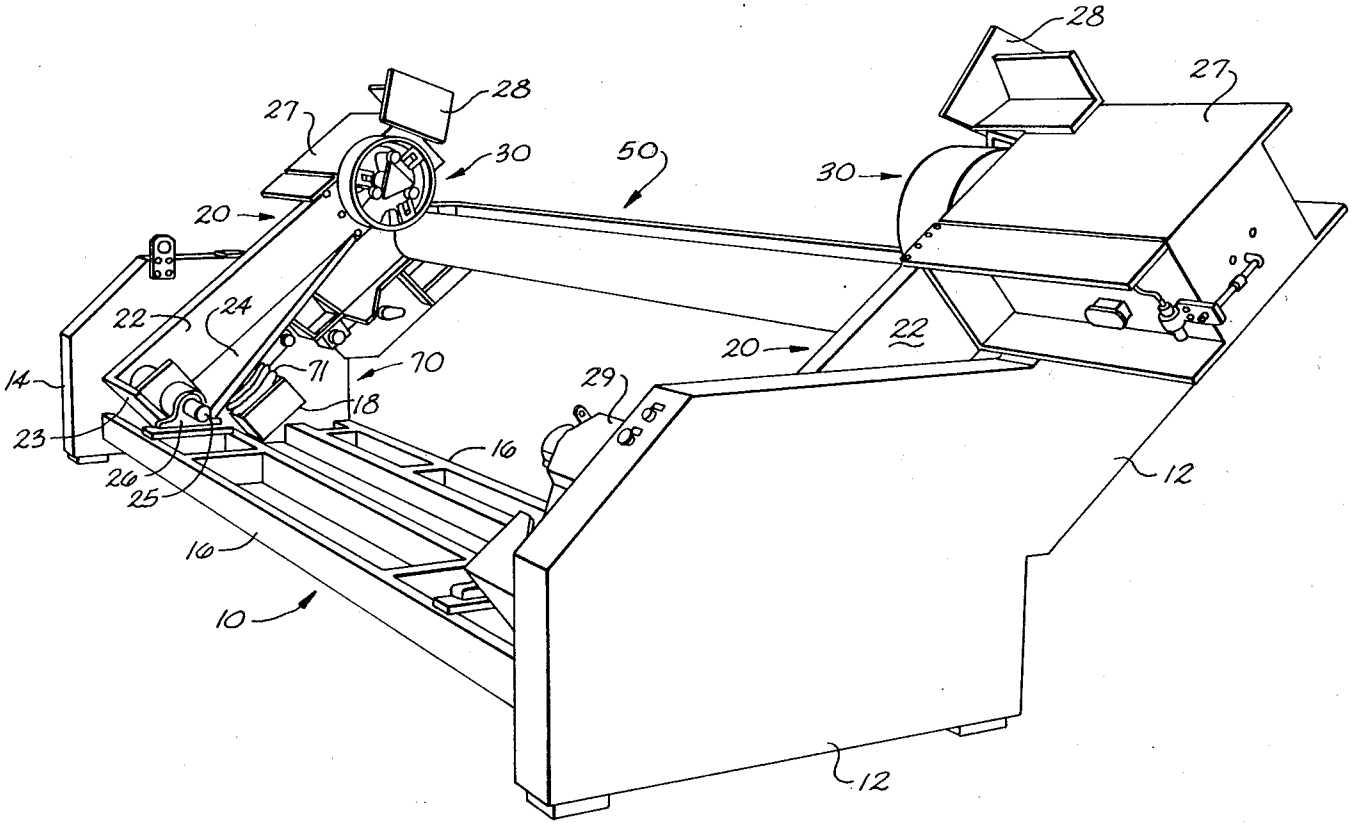
FIG. 1 is an isometric view of a preferred embodiment of a winder according to the present invention.

FIG. 1 illustrates a preferred embodiment of a winder according to the presention. A support frame generally indicated as 10 is provided having generally vertical end supports 12, 14 at opposite ends thereof with a plurality of crossing members 16 secured therebetween at a lower end of the apparatus. A pair of spaced-apart support arms generally indicated as 20, are secured to support frame 10 for pivotal movement thereabout. While only one of the pivotal support arms 20 is clearly illustrated in FIG. 1, the opposite support arm 20 is generally identical thereto except as otherwise discussed herein. Hence, specific discussion of one of the pivotal arms would likewise apply to the other.

Pivotal support arms generally 20 include an elongated support element 22 having a foot 23 secured to a lower end of same and extending outwardly therefrom. Foot 23, and element 22 have a bottom plate 24 secured thereto which extend partially along a bottom edge of element 22, tapering inwardly towards same. A shaft 25 is associated with a lower end of arm 22 and is rotatably supported by suitable bearings 26 that are secured to support frame 10 (only one bearing shown). Support arm 20 further has a housing 27 located at an outer free end of same, secured to element 22, and a deflector plate 28, both of which will be described in more detail hereinafter.

Support arms 20 are each provided, again at their outer free ends, with a rotatable chuck means generally indicated as 30 which is provided to receive and support a core or beam for the production of a roll of material therearound. Additionally, the winder is provided with a surface drive roll generally indicated as 50 located adjacent support arms 20 in the position as shown in FIG. 1 as would appear when roll formation begins, and extends across the space therebetween.

Support arms 20 are each further provided with a means for moving same between an empty position as the shown in FIG. 1 and a point where a full roll of web has been produced as will be described hereinafter. In FIG. 1 the arm moving means generally 70 is illustrated as an air bellows 71 which is received between a support platform 18 that is secured to frame 10 and an underside of reinforcing plate 24. While a bellows 71 is preferred as an arm moving means, obviously any other suitable means could be employed such as a hydraulic cylinder, screw activator or the like so long as such means can be appropriately manipulated to achieve a controlled winding as may be accomplished by the present invention. Also, when a bellows 71 is employed, it is preferable to include shock absorber means 72 or the like as shown in phantom in FIG. 2, to assist in stabilizing arm 22.

Figure 2:
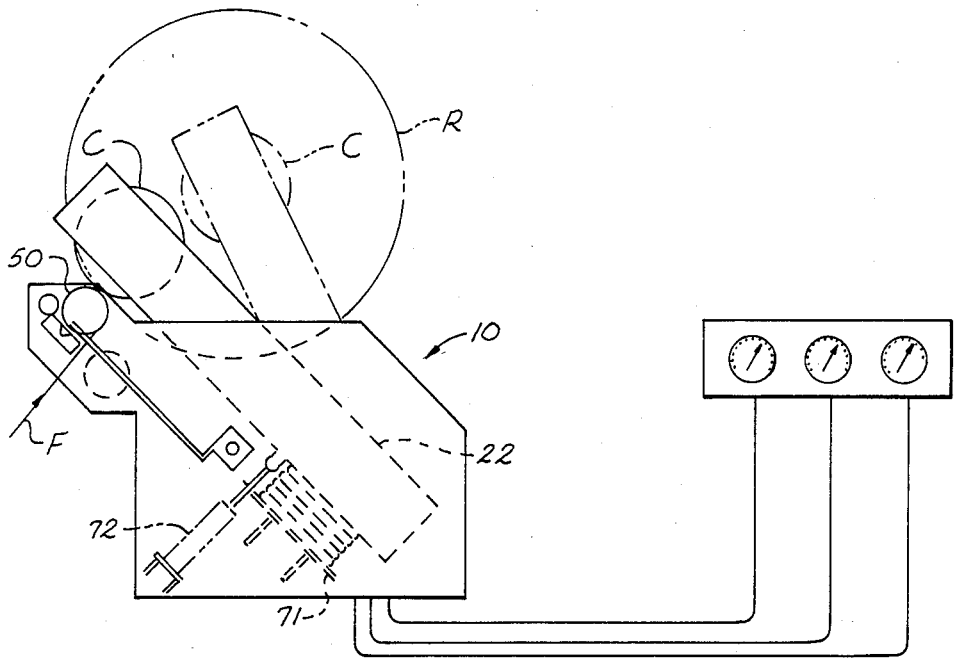
FIG. 2 is a partial side elevational view of a portion of a winder according to the present invention, illustrating the relationship between the surface drive roll and the pivotal support arms.
Figure 3:
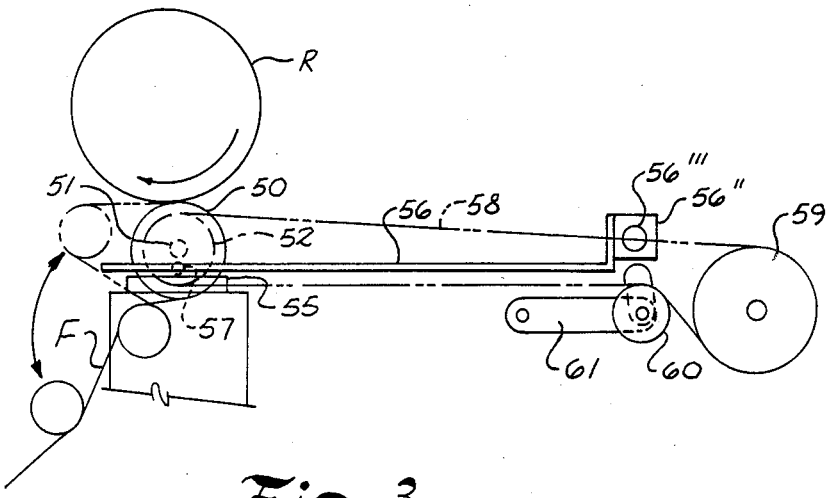
FIG. 3 is a schematic illustration of a surface drive roll arrangement according to the present invention in conjunction with a pressure sensor means associated therewith.
Figure 3A:
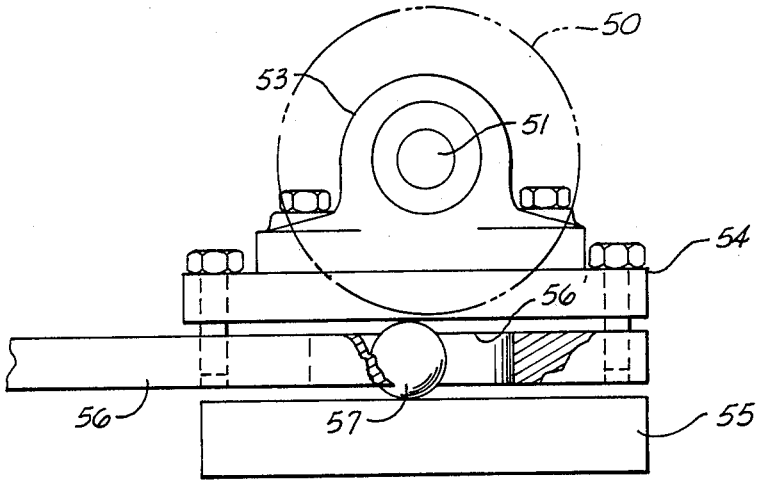
FIG. 3A is a more detailed illustration of the association between the surface drive roll and the pressure sensor according to the present invention.

Referring now to FIGS. 2, 3, and 3A, interrelationships between pivotal support arms 20 and the surface drive roll generally 50 will be described in greater detail. Roll 50 is received on a shaft 51 with a sprocket 52 located at an end of same. Shaft 51 is rotatably supported at opposite ends by a bearing assembly 53, which bearing assemblies 53 are, in turn, secured to bearing support plates 54 which, in turn, is secured to pivot arms 56 (see FIG. 3A). Located beneath each bearing support plate 54 is a load cell or pressure transducer 55 which is utilized to determine the nip pressure generated at the interface between drive roll 50 and the roll of web R being formed.

In order, however, to compensate for extraneous forces that could ordinarily be created by torque on the drive roll 50 produced by the driving means for same, elongated pivot rod 56 is located between an underside of bearing support plate 54 and an upper surface of load cell 55, and has a ball element 57 associated therewith in an elongated groove 56' through which the actual load force is applied. As illustrated particularly in FIG. 3A, ball element 57 resides in elongated groove 56' in pivot arm 56 and is capable of slight movement movement therein to compensate for slight angular deviations that may occur by displacement of drive roll 50. Furthermore, with elongated pivot rod 56 extending as far away from drive roll 50 as possible, same is secured to a support bracket 56'' which is pivotally secured to frame 10 at pivot 56'''. As stated above, it is desirable to eliminate any extraneous forces on load cell 55 that could be created by the drive means for roll 50. In order to do so, as can be specifically seen in FIG. 3, a chain or other endless drive element 58 is located between sprocket 52 on drive roll 50 and a driving pulley 59 secured to a source of power. Chain 58 passes over an idler roller 60 that is capable of angular displacement by being located on a pivotal rod 61. Moreover, an upper path of travel of chain driving element 58 as specifically shown in FIG. 3 passes through the plane of the pivot point 56''' for elongated pivot rod 56 to eliminate the extraneous forces.

As noted above, support arms 22 are provided with means for the proper location of same relative to surface drive roll 50, and in a preferred arrangement are illustrated as a pneumatic bellows 70. Hence as seen in FIG. 2, support arm 22 is shown in solid lines in the lowermost position where initiation of formation of a roll R will occur and in which position bellows 70 would be in a deflated or low pressure state. As fabric F is wound around core C, air is pulsed into bellows 70 from a compressed air source to move support arm 22 about its pivot point around shaft 16 at frame 10 in a fashion to maintain a predetermined nip pressure between drive roll 50 and core C or the outer layer of the roll R of web being wound. Such control continues until the full roll of material has been produced as is indicated in phantom in FIG. 2.

Various machine parameters may be set according to a particular style of fabric being wound and are according to a particular density required for the roll to ensure dyeing of the web. In a preferred arrangement, the winder of the present invention operates in a mode to attempt to maintain a uniform web density throughout the roll. In this regard, the speed of surface drive roll 50 is preferably related to the linear speed of web or fabric being fed thereto to achieve a one-to-one ratio, whereby fabric will be deposited onto the core and subsequent roll layers in substantially the same condition as exist when the fabric reaches surface drive roll 50. Such a condition is important, particularly with knit structures to attempt to retain an appropriate coarse count, or in other words, to appropriately maintain the number of picks per inch of the fabric being fed. Likewise, however, with the winder of the present invention, roll density may be controlled as desired. Particularly while presently a uniform, low fabric density is believed most desirable throughout the full diameter of the roll, fabric density may be varied as described by manipulation of target pressure value as discussed or by way of a program controller or the like.

Figure 7:
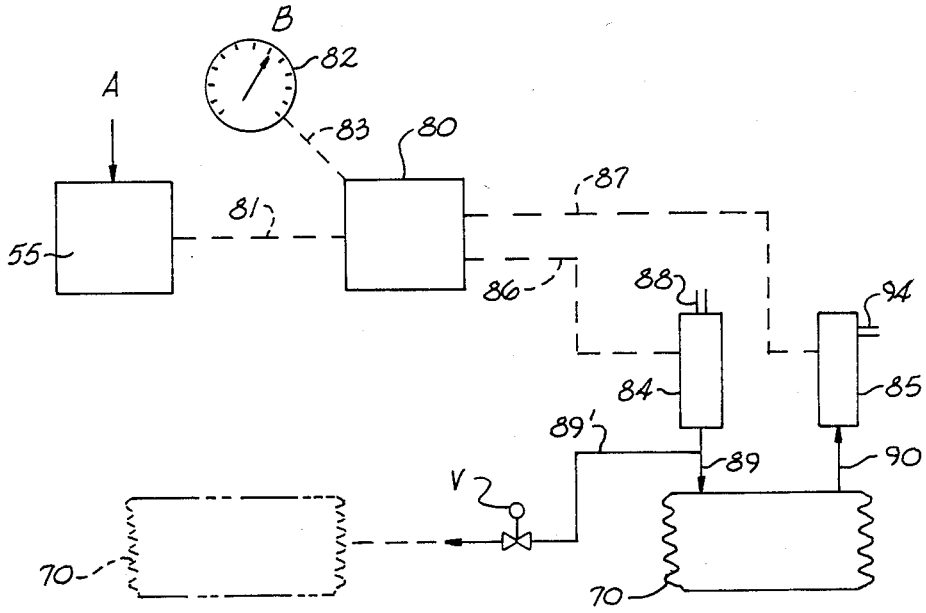
FIG. 7 is a schematic diagram of a control system for use with the present invention for maintaining controlled density of a roll of web being produced.

In FIG. 7, a preferred control system is illustrated for controlling the relationship between surface drive roll 50 and support arm 22 to fulfill certain of the objectives of the present invention. Surface drive roll 50 is appropriately rotatably supported at opposite ends, but is driven at one end only. Each end of surface drive roll 50 is, however, equipped with a load cell or pressure transducer 55 that is designed to determine the nip pressure at the drive roll drive-web roll interface. Since in a preferred arrangement the two pivotal support arms 22 are independent of each other, each support arm is preferably provided with a control system of the type as illustrated in FIG. 7. A discussion of the schematic diagram of FIG. 7 would thus apply to systems utilized with each support arm 22. As illustrated in FIG. 7, load cell 55 is shown with a force arrow A thereon representative of the nip pressure at drive roll 50, the force having a vector that is substantially transverse to the upper surface of load cell 55. As mentioned above, the arrangement of the present invention attempts to eliminate extraneous forces from load cell 55. Nip force A as detected by load cell 55 is inputed to an appropriate controller 80 by way of electrical connection indicated by dotted line 81. In like fashion, since it is desirable according to the present invention to attempt to maintain a constant nip pressure between surface drive roll 50 and web roll R or core C, as the case may be, a threshhold pressure B is preset on an appropriate indicator 82 such as a digital readout readout which likewise is inputted via electrical connection 83 to controller 80. Controller 80, includes suitable electrical components for comparison of force A as measured by load cell 55 with the threshhold or set point force B to determine whether force A is within an appropriate threshhold pressure range. Typically, two comparators (not shown) may be utilized with a first comparator making an initial comparison of the measured pressure A to threshhold pressure B and the second making a comparison to determine, should deviation exist, whether the deviation is above or below the threshhold pressure B. The comparators are operatively associated with a programmed controller and provide input thereto dependent upon the comparisons. The program controller is programmed to provide input to one of two solenoids 84 or 85 via appropriate electrical connectors 86 or 87, respectively. Solenoid 84 is in communication with a source of compressed air (not shown) through a conduit 88 while an opposite end of solenoid 84 communicates with an air bellows 70 via an air conduit 89. Solenoid 85 is likewise in communication with air bellows 70 via a conduit 90 and is provided with an exhaust port 94.

In the event that the controller 80 compares the force A produced on load cell 55 to the threshhold pressure B and determines that the force A is greater than the threshhold pressure B, solenoid 84 is actuated by controller 80 to pulse air into bellows 70 thus generating movement of pivotal arm 22 adequate to reduce the applied force A. Such pulsing of air through solenoid 84 will continue until such time as the applied force A appropriately compares to the threshhold force B or falls within the preset limits for same. At such time solenoid 84 would be deactuated by controller 80 and the air within bellows 70 will then remain static. Conversely, should applied force A be determined to be less than the threshhold force B, controller 80 will actuate solenoid 85 which, in turn, opens exhaust port 91 and permits air to escape from within bellows 70. Again, solenoid 85 will remain actuated until such time that the applied force A again appropriately compares to the threshhold force B.

Preferably, time delays are incorporated into the controller 80 prior to solenoid actuation to ensure correctness of signal inputs thereto. Also, particularly during start-up, an out of round beam can create false nip pressure signals for each or both arms 22. In fact, out of round beams can create a condition of instability of arm movement. In order to compensate for same, an air bleeder line 89' is connected between the two bellows 70 for arms 22 with a valve V located therein. Air being supplied to one bellows 70 responsive to controller 80 may thus be directed in part to the bellows 70 for the other arm 22, and consequently reduces substantially the instability problem noted above.

Figure 4:
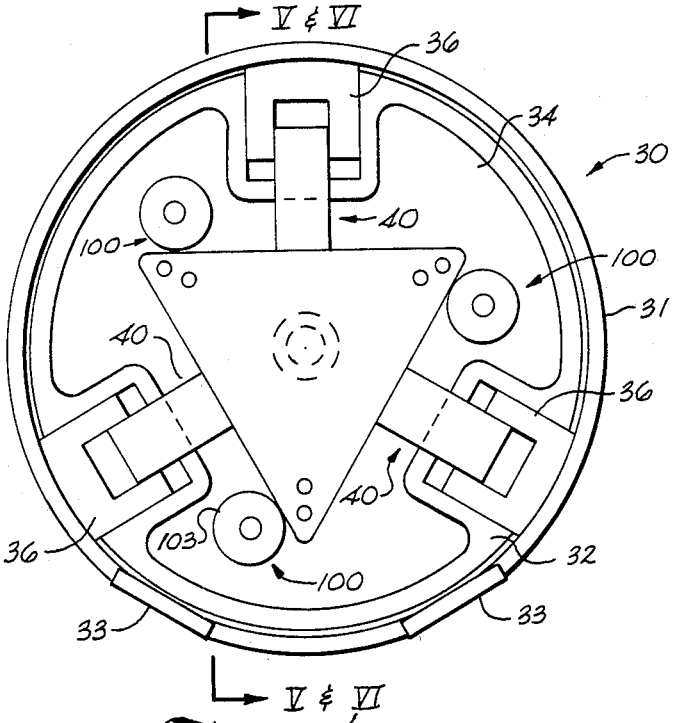
FIG. 4 is an end view of a preferred chuck means utilized with a winder according to the present invention.
Figure 5:
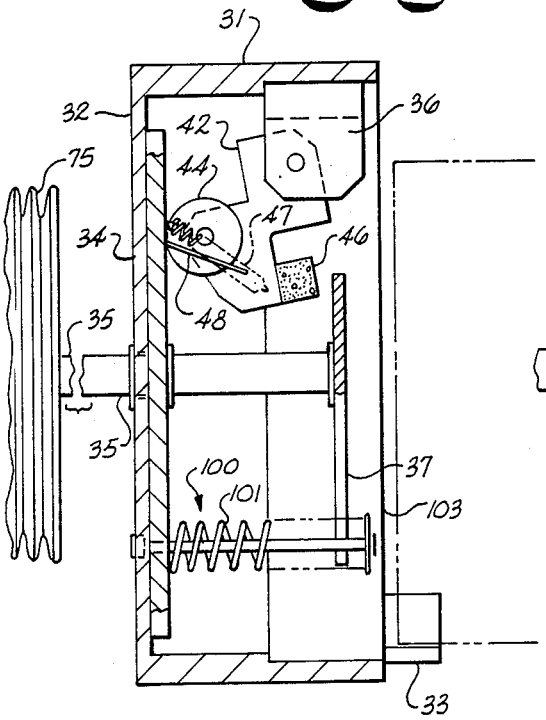
FIG. 5 is a vertical cross-sectional view of the chuck means as shown in FIG. 4 taken along a line V—V with one core holding means retracted within the chuck housing.
Figure 6:
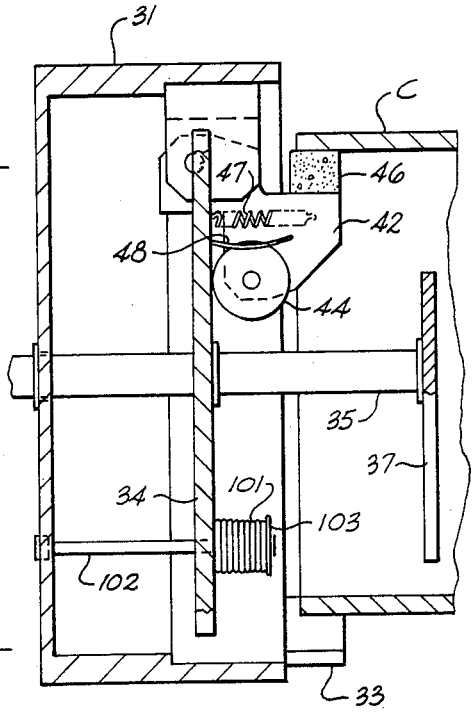
FIG. 6 is a further vertical cross-sectional view taken along a line V—V of FIG. 4 illustrating one core holding means in an extended, core holding position.

FIGS. 4–6 more particularly illustrate unique chuck means 30 that are utilized in conjunction with the present invention. As shown in FIG. 1, a chuck means 30 is rotatably received at an outer free end of each support arm 20. One of the two chuck means 30 is freely rotatable at its associated support arm 20 such as the one more clearly shown in FIG. 1, while the opposite chuck means 30 is driven. As shown in FIG. 1, for example, a motor 29 is provided and is in chain drive connection to the right most chuck means 30 to apply a particular, preset torque thereto. During the winding operation the center torque on chuck 30 assists in rotating roll R as same is being formed. As mentioned hereinbefore, conventional chucks used on winders have historicaly employed conically shaped elements that, when a core is properly positioned adjacent the chuck means, it is inserted into the open ends of the core to rotatably support same. Not only does such an arrangement require excess effort in the positioning of the core with respect to the chuck, but also since the conically shaped elements have historically been metal, continued use of same leads to enlargement of the open ends of the core ultimately requiring reworking of the core. The chuck means of the present invention, however, does not require the same type positioning operation as prior art chucks, and further means employed therewith for holding the core are nondestructive to the core.

Chuck means 30 includes a cylindrical housing 31 having a back wall 32 and an open front. A pusher plate 34 is received adjacent rear or back wall 32 and is appropriately secured to a pusher rod 35 which extends rearwardly of same through an appropriate opening in rear wall 32 and beyond where it is operatively associated with a drive means for operating chuck 30, preferably a pneumatic bellows 75 as schematically illustrated in FIG. 5. Such drive means for chuck 30 are located within housings 27 secured to winder frame 10. Also located within cylindrical housing 31 are a plurality of jaws generally indicated as 40 which are pivotally secured therein for movement between a retracted position as shown in FIG. 5 and an extended position as shown in FIG. 6. Three such jaws 40 are illustrated in FIG. 4 spaced 120° apart around housing 31, while in FIGS. 5 and 6, only one such jaw arrangement is illustrated for simplicity. Each jaw 40 includes a plate 42 which is pivotally secured at one end to bracket 36 and extends outwardly therefrom. A roller 44 or other type follower means, is secured to a portion of plate 42 and makes contact with pusher plate 34, while at an opposite end of plate 42 there is located a generally resilient contact element 46. A spring 47 is secured between pusher plate 34 and plate 42. Additionally a cable 48 may likewise be connected between plate 42 and a portion of pusher plate 34. Chuck 30 is further provided with a safety support element 37 that normally resides within housing 31 in front of jaws 40 and as illustrated, is connected to pusher plate 34 for movement therewith. In an operative state, support element 37 resides within an open end of a core C and serves as a backup safety device in the event of failure of one or more of the jaws 40 to preclude core C from inadvertently falling from chuck 30.

Referring particularly to FIGS. 5 and 6, operation of chuck means 30 will now be described. With chuck 30 in the inoperative state as illustrated in FIG. 5, a core C may be positioned in front of same and brought to rest on cradle elements 33 which both positions the core C for subsequent holding engagement by chuck 30 and likewise permits the overhead crane, hoist or the like used for moving same to be disassociated therefrom. A phantom outline of an end of a core C is illustrated in FIG. 5 making engagement with cradle elements 33. Once core C is properly located on cradle elements 33, the driving means such as the pneumatic bellows 75 receives power input, such as air and moves pusher rod 35 outwardly therefrom which moves pusher plate 34 forward. As pusher plate 34 moves forward, rollers 44 for each of the jaws 40 will roll therealong causing jaw plate 42 to pivot about its pivot point 36. While not illustrated, if desirable, appropriately shaped grooves may be provided on pusher plate 34 for receipt and maintenance of jaw rollers 44. When pusher plate 34 is moved forward an adequate distance, jaws 40 complete a full pivot bringing contact elements 46 into engagement with an interior wall of core C (see FIG. 6). As can be seen in FIG. 6, when the upper jaw 40 moves into contact with an inside of core C, core C is lifted off of cradle elements 33 and is held suspended by the three jaws 40. With chucks 30 at opposite ends of core C in place the winding operation can then commence. As mentioned above a plate 37 is likewise located within an open end of core C to provide a backup safety device in the event of failure of one or more jaws 40. Since pneumatic bellows 75 is employed as a driving force for operation of chucks 30, once air is removed therefrom, the pusher plate 34 is then permitted to return to its inactive position adjacent rear wall 32 of housing 31. Pusher plate 34 core C is lifted off of cradle elements 33' and is held suspended by the three jaws 40. With chucks 30 at opposite ends of core C in place the winding operation can then commence. As mentioned above a plate 37 is likewise located within an open end of core C to provide a backup safety device in the event of failure of one or more jaws 40. Since pneumatic bellows 75 is employed as a driving force for operation of chucks 30, once air is removed therefrom, the pusher plate 34 is then permitted to return to its inactive position adjacent rear wall 32 of housing 31. Pusher plate 34 is provided with three spring means generally 100 which include a compressible coil spring 101 received around a rod 101 that is secured to back wall 32 of housing 31 and passes through pusher plate 34, and at a forward end terminates at a washer element 103. As can be seen in FIG. 5, only one such spring means 100 is shown with the coil spring 101 in an expanded condition whereas in FIG. 6, movement of pusher plate 34 forward compresses spring 101 between plate 34 and an underside of washer element 103 such that upon release of pressure against pusher rod 35, springs 102 will expand and will return pusher plate 34 to its rearward, inactive position. As pusher plate 34 returns to its inactive position, jaw springs 48 are tensioned to cause jaws 40 to pivot rearwardly from the extended to the retracted shown in FIG. 3 in solid lines or as shown in phantom, to pass between surface drive roll 50 and core C and due to torque drive on core C and rotary driving motion of roll 50, is wound onto core C. Obviously thread-up will be determined by the direction of rotation of core C and roll 50.

As fabric F is wound around core C, roll R becomes progressively bigger, and additional fabric layers between core C and surface drive roll 50 continuously increase nip pressure at the drive roll interface unless core C is moved away from drive roll 50. As illustrated and preferred, pneumatic bellows 70 are located beneath pivotal support arms 20, and as fabric F is wound around core C, air is introduced into bellows 70, expanding same and moving arms 20 around their pivot points away from surface drive roll 50.

Since controlled density of fabric on roll R is a thrust of the present invention, movement of support arms 20 away from drive 50 is controlled. Surface drive roll 50 is provided with pressure sensors, preferably load cells 55 at each end of same to detect the magnitude of nip pressure generated at the interface between roll 50 and core C or the outer layer of roll R as it is being formed. Web density on roll R can be controlled by control of the aforesaid nip pressure. Measured pressure at load cells 55 is compared to a target pressure and air flow into bellows 70 is controlled responsive to the comparison to maintain the nip pressure at the target pressure point or wihtin a target range. A controller 80 receives inputs of target and measured pressures and actuates air solenoids 84 or 85 responsive to detected deviation to inflate or deflate bellows 70 responsive thereto adequate to maintain nip pressure at drive roll 50 on target.

Preferably, the two support arms 20 are independent of each other with each having a nip pressure control system as discussed above. Further, since during formation of roll R, the weight of the roll should continually increase, nip pressures also should only increase, and no decreases should normally be detected. Accordingly, a long time delay is incorporated into the control system (around 10 seconds) prior to institution of correction to deflate bellows 70 and create an increased measured nip pressure.

Also, occasionally when a core is first introduced to the winder, measured nip pressure decreases can occur due to an "out of round" core, and can lead to an unstable control system until adequate fabric is wound onto core C to compensate for the irregularities. To compensate for such, the bellows 70 for the two arms 22 are interconnected with a fluid bleed line 89' having a valve means V therein. Bleed line 89' thus partially equalizes pressures within both bellows 70 and eliminates some of the instability referred to above.

With roll speeds properly set and nip pressures continuously monitored, a fabric roll R may be produced having a fabric density thereon as desired. Such density may be constant throughout the roll, or with the assistance of an appropriate programmed controller, could be varied as desired. After roll R is formed, chucks 30 are disengaged therefrom and the roll is removed from the winder by conventional means.

It will be understood, of course, that while the form of the invention herein shown and described constitutes preferred embodiments of the invention, it is not intended to illustrate all possible forms of the invention. It will also be understood that the words used are words of description rather than of limitation and that various changes may be made without departing from the spirit and scope of the invention herein disclosed.

What is claimed is:

1. An improved winder for producing a roll of web material comprising:

(a) a support frame;

(b) a pair of spaced apart arms independently pivotally secured to said frame, said arms having chuck means at outer free ends of same for receiving and supporting a winding core therebetween;

(c) means for moving said arms about said pivotal connections to properly locate said arms for receiving web therearound;

(d) a surface drive roll located across the space between said arms and supported for rotation thereat;

(e) drive means for at least one of said chucks and for said surface drive roll;

(f) pressure sensor means associated with said surface drive roll for determining nip pressure generated at two interfaces between said web being wound and said surface drive roll; and (g) control means operatively associated with said arm moving means and said sensor means for independently locating each of said arms relative to said drive roll to maintain a predetermined nip pressure at said drive roll interfaces.

2. A winder as defined in claim 1 wherein said means for moving said arms are pneumatic.

3. A winder as defined in claim 2 wherein said pneumatic means include a bellows positioned between a part of said support frame and said arm.

4. A winder as defined in claim 1 wherein said chuck means located at said outer free ends of said arms comprise a housing, means secured to said housing for initial receipt of a winding core thereon, a plurality of core holding elements pivotally secured within said housing and being movable about said pivotal securement between said housing and an extended position where said holding elements engage an inside surface of said core adjacent an end of same, said plurality of holding elements cooperating to support said end of said core, and means for moving said core holding elements between retracted and extended positions.

5. A winder as defined in claim 1 wherein said sensor means associated with said surface drive roll is a pressure transducer.

6. A winder as defined in claim 1 wherein said control system comprises means for presetting a target nip pressure, controller means electrically associated with said target setting means and said transducer for receiving inputs therefrom representative of pressures and comparing same, actuator means electrically associated with said controller and in actuating communication with said arm moving means, whereby when pressure sensed at said transducer deviates from said target pressure, said actuator means causes said arm to move in a compensating direction to maintain said nip pressure at said target value.

7. A winder as defined in claim 6 wherein said controller includes comparator means and a programmed controller, said actuator means is a pair of solenoids and said arm moving means is a fluid bellows, a first one of said solenoids being in communication with a source of fluid and said bellows, and a second of said solenoids being in communication with said bellows and the atmosphere, whereby a detected deviation in nip pressure will cause said program controller to actuate said first solenoid to introduce fluid to said bellows or said second solenoid to exhaust fluid from said bellows dependent upon the direction of deviation from the target pressure.

8. An improved winder for producing a roll of web material comprising:

(a) a support frame;

(b) a pair of spaced apart arms pivotally secured to said frame, said arms having a chuck means at outer free ends of same for receiving and supporting a winding core therebetween;

(c) means for moving said arms about said pivotal connections to properly locate said arms for receiving web therearound;

(d) a surface drive roll located across the space between said arms and supported for rotation thereat;

(e) pressure transducer sensor means associated with said surface drive roll for determining nip pressure generated at an interface between said web being wound and said surface drive roll;

(f) drive means for said surface drive roll located to eliminate extraneous pressures on said pressure transducer; and (g) control means operatively associated with said arm moving means and said sensor means for locating said arms relative to said drive roll to maintain a predetermined nip pressure at said drive roll interface.

9. A winder as defined in claim 8 wherein said surface drive roll comprises a roll supported on a shaft, said shaft being rotatably supported by bearings, said bearings being mounted on a support plate, said pressure transducer being located beneath said bearing support plate and wherein an elongated pivot arm is located between said bearing support plate and said pressure transducer for transmitting pressure from said bearing support plate to said transducer, said drive roll being interconnected with drive means therefor by way of an endless driving element, said driving element passing through a plane of the pivot point of said pivot arm.

10. A winder as defined in claim 9 wherein said pivot arm has a spherical element associated therewith, said spherical element extending beyond opposite edges of said pivot arm and contacting said bearing support plate and said transducer.

11. An improved machine for producing a roll of web material comprising:

(a) a support frame;

(b) a pair of spaced apart support arms pivotally secured to said frame for movement thereabout;

(c) chuck means rotatably received at outer free ends of said support arms for receiving a winding core therebetween, said chuck means comprising a cylindrical housing, a plurality spaced-apart static support elements secured to an outer free end of said housing for initial receipt of a core, and a plurality of core holding elements pivotally secured within said housing and being movable between a retracted position within said housing and an extended position where said holding elements engage an inside surface of a core adjacent an end of the same, said plurality of holding elements cooperating to support said core, and means for moving said core holding elements between retracted and extended positions; and (d) drive means operatively associated with said core for imparting rotation thereto for producing a roll of web material thereabout.

12. A machine as defined in claim 11 wherein said core holding elements comprise an arm having a roller rotatably secured to a portion of same, and having a generally resilient element located at an end of said arm for making holding contact with said core, and wherein said means for moving said core holding means between a retracted and an extended portion includes a plate element received within said housing and being movable axially with respect to said housing, said rollers being contactable by said plate element and rolling along said plate element during movement of said plate element to cause pivotal movement of said arms to bring said resilient elements into holding contact with said core.

13. A machine as defined in claim 12, wherein spring means are secured between said plate element and said arms to retract said core holding elements during retraction of said plate element.

14. A machine as defined in claim 12 wherein said generally resilient element is a urethane pad.

15. A machine as defined in claim 11 wherein three core holding elements are pivotally secured within said housing, said core holding elements being equally spaced around said housing.

16. A machine as defined in claim 11 wherein said means for moving said core holding elements about their pivotal securement comprises a plate received within said housing rearward of said core holding elements, and means to apply force against said plate element to cause movement of same in a direction generally axially with respect to said housing, forward movement of said plate forcing said core holding elements about their pivotal securement to an extended, core holding position.

17. A machine as defined in claim 16 wherein said force applicator means is pneumatic.

18. A machine as defined in claim 17 wherein said plate element has spring return means associated therewith to retract said plate upon removal of pneumatic force thereagainst.

19. A machine as defined in claim 11 wherein said drive means for imparting rotation to said core comprises a surface drive roll supported by said frame across the space between said support arms and contactable with a roll of web material beig formed, and drive means therefor.

20. A machine as defined in claim 19 wherein said drive means further comprise torque drive means for at least one of said chuck means.

21. A machine as defined in claim 20 wherein pressure sensor means are associated with said surface drive roll to measure nip pressure at the interface between said drive roll and said roll of web material, and means are associated with said arms for pivotal movement of same, and wherein a control system is operatively associated with said sensor means and said arm movement means for moving said arms during production of said web material while maintaining a predetermined nip pressure at said drive roll interface.

22. An improved winder for producing a roll of web material comprising:

(a) a support frame;

(b) a pair of spaced apart support arms pivotally secured to said frame;

(c) each said support arm having means associated therewith for independently moving said arm about its pivotal connection;

(d) a surface drive roll located across the space between said support arm and being supported for rotation thereat;

(e) chuck means rotatably supported at an outer free end of each support arm, said chuck means comprising a housing; a plurality of core holding elements pivotally secured within said housing, said core holding elements being equally spaced apart around said housing and being movable between a retracted, inactive position and an extended, core holding position, and means for moving said core holding elements between their retracted and extended positions;

(f) drive means for at least one of said chucks and for said surface drive roll;

(g) pressure sensor means operatively associated with said surface drive roll at each end of same to determine nip pressure generated at the interfaces between each end of said surface drive roll and said web roll being formed; and (h) control means operatively associated with each said support arm moving means and each said pressure sensor means for independently locating said support arms relative to said surface drive roll for maintaining a predetermined nip pressure at said drive roll interfaces.

23. An improved winder as defined in claim 22 wherein said means for moving said core holding elements from a retracted to an extended position comprises an expandable pneumatic element, a pusher rod associated with said expandable element and extending outwardly therefrom, into said chuck housing from a rear side of same and a pusher plate secured to said pusher roll within said housing, expansion of said element forcing said pusher plate towards an open end of said housing with said pusher plate forcing said core holding elements about their pivotal securement to an extended core holding position.

24. A winder as defined in claim 23 wherein said pusher plate has spring return means associated therewith to return said pusher plate to a rear of said chuck housing upon deflation of said expandable element.

25. A winder as defined in claim 23 wherein said means for moving said arms are pneumatic.

26. A winder as defined in claim 23 wherein said core holding elements are connected to said pusher plate to be returned to the retracted position upon retraction of said pusher plate.

27. A winder as defined in claim 22 wherein said chuck means further includes safety core support means received within said housing, said safety support means being spaced from said pusher plate and secured thereto for movement into an end of said core when said pusher plate is moved forward, whereby should one or more of said core holding elements malfunction, said safety support means will preclude said core from falling from said chuck means.

28. A method of winding a web onto a core while controlling density of the web on the core comprising the steps of:

(a) supporting a core between two independently, pivotally mounted support arms, adjacent and contactable with a surface drive roll;

(b) applying a rotational driving force to said core and said surface drive roll while feeding a web to said surface drive roll in a fashion that said web is forwarded by said surface drive roll onto said core and is wound therearound;

(c) measuring nip pressure at a plurality of interfaces between the surface drive roll and the roll of web being formed; and (d) independently positioning each of said support arms relative to said surface drive roll to maintain nip pressure at each of said interfaces at a predetermined level.

29. A method as defined in claim 28 wherein said rotational driving force for said core is a torque drive.

30. A method as defined in claim 28 wherein said nip pressure at each of said interfaces is measured by load cells located under supports for said surface drive roll.

31. A method as defined in claim 30 wherein said measured nip pressure and said arms are positioned responsive to deviation between said target and measured nip pressures to maintain said measured nip pressure at said target pressure level.

32. A method as defined in claim 31 wherein said arms are positioned by pivotal movement of same away from said surface drive roll.

33. A method of winding a web onto a core while controlling the density of the web wound around the core comprising the steps of:

(a) supporting a core between two pivotally independently mounted support arms;

(b) bringing said core into contact with a surface drive roll;

(c) feeding web to be wound between said surface drive roll and said core while driving said surface drive roll at a speed relative to linear speed of web being fed thereto and applying torque drive to said core for winding said web around said core;

(d) independently measuring nip pressure at a plurality of interfaces between said surface drive roll and said web and between said drive roll and said core; and (e) independently positioning each of said support arms for said core relative to the surface drive roll to maintain nip pressure on said web at a predetermined value.

* * * * *

UNITED STATES PATENT AND TRADEMARK OFFICE

CERTIFICATE OF CORRECTION

PATENT NO. : 4,742,968

DATED : May 10, 1988

INVENTOR(S) : William O. Young, Jr. et al

It is certified that error appears in the above-identified patent and that said Letters Patent is hereby corrected as shown below:

The title page should be deleted to appear as per attached sheet.

Signed and Sealed this

Eighteenth Day of October, 1988

*Attest:*

DONALD J. QUIGG

*Attesting Officer*

*Commissioner of Patents and Trademarks*

United States Patent [19]

Young, Jr. et al.

[11] Patent Number: 4,742,968

[45] Date of Patent: May 10, 1988

[54] BEAM WINDER AND METHOD OF USING SAME

[75] Inventors: William O. Young, Jr., Spartanburg; Mansel A. Jennings, Inman; George H. Lark; Julian E. Hankinson, Jr., both of Spartanburg, all of S.C.

[73] Assignee: Young Engineering, Inc., Spartanburg, S.C.

[21] Appl. No.: 860,642

[22] Filed: May 7, 1986

[51] Int. Cl.[4] ..... B65H 17/02; B65H 17/08; B65H 23/00

[52] U.S. Cl. ..... 242/65; 242/72 R; 242/72.1; 242/75.2

[58] Field of Search ..... 242/65, 68.4, 75.2, 242/72 R, 72.1

[56] References Cited

U.S. PATENT DOCUMENTS

| | | | |
|---|---|---|---|
| 2,922,592 | 1/1960 | Kaltenbach | 242/72 X |
| 3,670,980 | 6/1972 | Mukai et al. | 242/75.2 X |
| 3,687,388 | 8/1972 | Pfeiffer | 242/65 |
| 3,946,960 | 3/1976 | Hunter | 242/65 |
| 4,111,377 | 9/1978 | Tetro et al. | 242/65 X |
| 4,150,797 | 4/1979 | Kataoka | 242/75.2 X |
| 4,552,317 | 11/1985 | Halter | 242/75.2 X |

*Primary Examiner*—Stuart S. Levy
*Assistant Examiner*—Thomas R. Hannon
*Attorney, Agent, or Firm*—Dority & Manning

[57] ABSTRACT

A winder for textile fabrics or other web materials including a frame having spaced apart support arms pivotally secured thereto. Each support arm has a core holding chuck at the outer end of same, at least one of which is torque driven. A surface drive roll is located on the frame to receive material and apply same to the roll of material being produced. A load cell associated with the surface drive roll measures nip pressure at the interface between the surface drive roll and the roll being formed and is associated with a pneumatic bellows or the like via a control system to cause movement of the support arm for maintenance of a predetermined nip pressure at the drive roll interface. The chucks for holding winding cores include a plurality of arms pivotally secured within a chuck housing which are pivotally movable to an extended core engaging position.

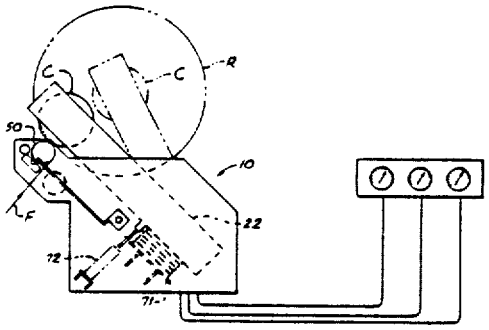

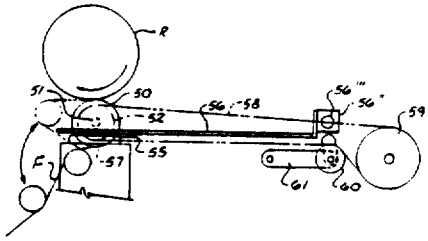

33 Claims, 4 Drawing Sheets